US008061430B2

(12) United States Patent
Du et al.

(10) Patent No.: US 8,061,430 B2
(45) Date of Patent: Nov. 22, 2011

(54) RE-SETTABLE AND ANTI-ROTATIONAL CONTRACTION JOINT WITH CONTROL LINES

(75) Inventors: Michael H. Du, Pearland, TX (US); Claus Endruhn, Houston, TX (US); David Verzwyvelt, West Columbia, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 326 days.

(21) Appl. No.: 12/400,504

(22) Filed: Mar. 9, 2009

(65) Prior Publication Data

US 2010/0224375 A1 Sep. 9, 2010

(51) Int. Cl.
*E21B 43/10* (2006.01)

(52) U.S. Cl. ..... 166/380; 166/207

(58) Field of Classification Search ..... 285/330, 285/302, 138, 133, 321; 64/23; 175/321, 175/81, 92; 166/192, 292, 380
See application file for complete search history.

(56) References Cited

U.S. PATENT DOCUMENTS 3,718,183 A * 2/1973 Scott ..... 166/359
4,281,858 A * 8/1981 Bowyer ..... 285/39
4,295,665 A 10/1981 Pierce
4,423,889 A * 1/1984 Weise ..... 285/39
5,343,949 A * 9/1994 Ross et al. ..... 166/278
5,447,201 A * 9/1995 Mohn ..... 166/375
5,566,772 A * 10/1996 Coone et al. ..... 175/321
7,398,822 B2 7/2008 Meijer et al.
7,806,190 B2 * 10/2010 Du ..... 166/380
2002/0179306 A1 12/2002 Johnson et al.
2005/0072564 A1 4/2005 Grigsby et al.
2006/0000618 A1 1/2006 Cho et al.
2006/0260803 A1 11/2006 Meijer et al.
2006/0260817 A1 11/2006 Meijer et al.
2006/0260818 A1 11/2006 Meijer et al.
2008/0029274 A1 2/2008 Rytlewski et al.
2009/0078430 A1 3/2009 Du et al.
2010/0175882 A1 * 7/2010 Bailey et al. ..... 166/335
2010/0224375 A1 * 9/2010 Du et al. ..... 166/380

* cited by examiner

*Primary Examiner* — Shane Bomar
*Assistant Examiner* — Oleg V Merkoulov
(74) *Attorney, Agent, or Firm* — Rodney Warfford; Tim Curington; Robb Edmonds

(57) ABSTRACT

A downhole contraction joint. The downhole contraction joint can include at least one anti-rotation assembly. The anti-rotation assembly can include a first tubular member at least partially disposed within a second tubular member. An axial slot can be formed through at least a portion of the first tubular member, and at least one key can be at least partially disposed within the second tubular member and the axial slot. The downhole contraction joint can also have at least one resetting assembly disposed at a first end of the anti-rotation assembly. The resetting assembly can include a c-ring secured to the second tubular member. The first tubular member can be secured to the lock ring, and the lock ring can be aligned with the c-ring. The downhole contraction joint can also include at least one control line assembly disposed about a portion of the anti-rotation assembly.

20 Claims, 5 Drawing Sheets

RE-SETTABLE AND ANTI-ROTATIONAL CONTRACTION JOINT WITH CONTROL LINES

BACKGROUND

Downhole operations typically utilize a string of tubulars, tools, or assemblies that are in fluid communication between some depth within a wellbore and the surface. Contraction joints are typically used somewhere along those strings, such as between two or more completion assemblies, to accommodate axial expansion and/or contraction of the string within the wellbore. Such expansions and contractions typically result from thermal fluctuations within the wellbore.

Wellbore completions typically utilize one or more control lines, such as optical, electrical, and/or hydraulic control lines, to carry signals between components within the wellbore and/or the surface. It can be difficult to control or maintain the integrity of those control lines at a contraction joint because axial movement of the contraction joint can cause the lines to knot or tangle as the contraction joint expands or contracts.

In some cases, contraction joints are used to translate axial movement to a completion assembly in order for the completion assembly to be actuated or operated within the wellbore. For example, a mechanically actuated packer requires the application of an axial force thereto to set the packer within the annulus of the wellbore. Such axial force will have to translate through a contraction joint that is disposed along the work string, if the contraction joint is disposed between the source of the axial force and the packer receiving the axial force. In situations where a work string has two or more packers or other mechanically actuated tools or completions, a contraction joint might have to be reset after the application of a first axial force through the work string to the completion assembly. The resetting of the contraction joint can allow the application of a second or additional setting force through the work string to a subsequent completion assembly. When a work string includes rotational equipment, such as a rotating pump or pumping system, a contraction joint might also need to accommodate rotation of one or more completion assemblies.

There is a need, therefore, for a contraction joint that can accommodate rotation of one or more completion assemblies; that can accommodate control lines; and that has a setting or resetting mechanism allowing for multiple axial forces to be translated therethrough.

SUMMARY

One or more downhole contraction joints and methods of using at least one of the downhole contraction joints are provided. The downhole contraction joint can include at least one anti-rotation assembly. The anti-rotation assembly can include a first tubular member at least partially disposed within a second tubular member. An axial slot can be formed through at least a portion of the first tubular member, and at least one key can be at least partially disposed within the second tubular member and the axial slot. The downhole contraction joint can also have at least one resetting assembly disposed at a first end of the anti-rotation assembly. The resetting assembly can include a c-ring secured to the second tubular member. The first tubular member can be secured to the lock ring, and the lock ring can be aligned with the c-ring. The downhole contraction joint can also include at least one control line assembly disposed about a portion of the anti-rotation assembly. The control line assembly can include an axially compliant housing for containing one or more control lines.

One or more of the methods of using one or more of the downhole contractions joints can include connecting a first completion assembly with a second completion assembly using at least one of the contraction joints. The method can also include preventing axial movement of the first tubular member relative to the wellbore with the first completion assembly, and axially moving the second tubular member about the first tubular member by applying axial force to the second completion assembly. The method can continue by preventing axial movement of the second completion assembly relative to the wellbore. Compensating for contraction and expansion of at least one of the completion assemblies by allowing the second tubular member to axially travel about the first tubular member.

BRIEF DESCRIPTION OF THE DRAWINGS

So that the recited features can be understood in detail, a more particular description, briefly summarized above, may be had by reference to one or more embodiments, some of which are illustrated in the appended drawings. It is to be noted, however, that the appended drawings illustrate only typical embodiments and are therefore not to be considered limiting of its scope, for the invention may admit to other equally effective embodiments.

DETAILED DESCRIPTION

Figure 1:
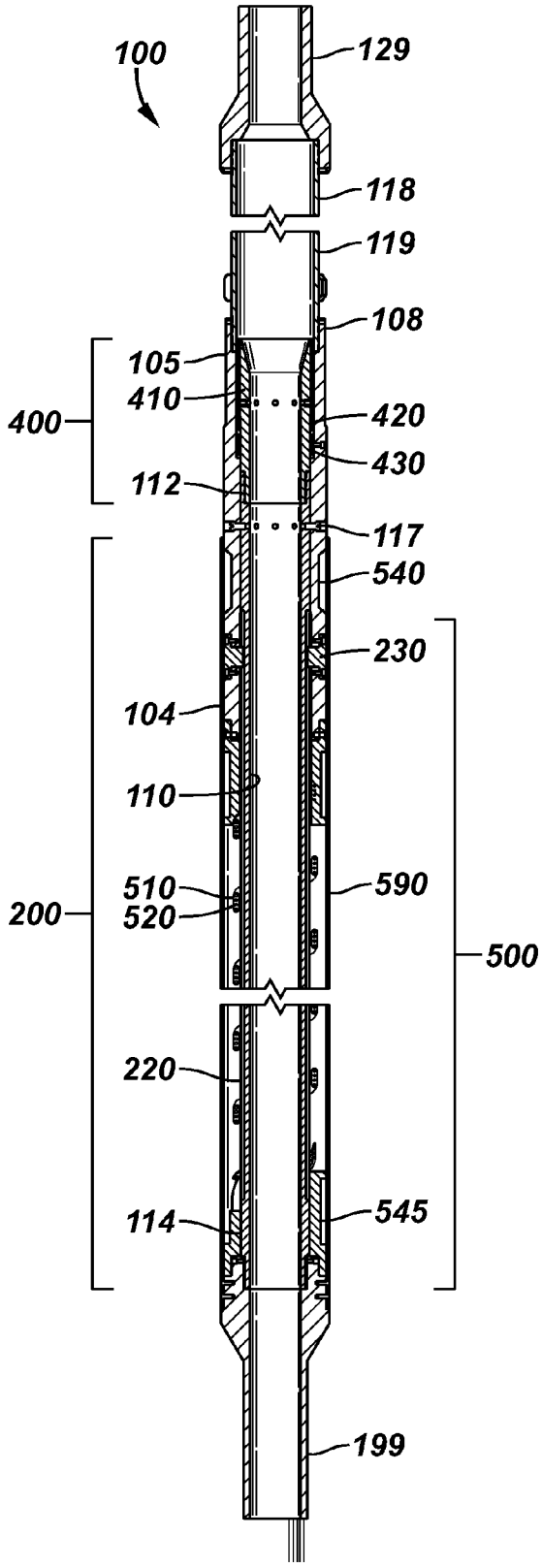
FIG. 1 depicts a partial cross section view of an illustrative contraction joint, according to one or more embodiments described.

FIG. 1 depicts a partial cross section view of an illustrative contraction joint 100, according to one or more embodiments. The contraction joint 100 can include a first tubular member 110 at least partially disposed within a second tubular member or housing 105. The contraction joint 100 can also include one or more anti-rotation assemblies or sections 200; one or more a re-setting assemblies or sections 400; and one or more control line assemblies or sections 500.

The first tubular member 110 can be attached or otherwise connected to a bottom sub 199 at a lower end or portion 114 thereof. The bottom sub 199 can be configured to engage a completion assembly, a packer, or another downhole piece of well equipment. The second tubular member 105 can be at least partially disposed about the first tubular member 110. For example, a "lower" or second end 104 of the second tubular member 105 can be disposed about the first tubular member 110. The second tubular member 105 can be adapted or configured to slide about the outer diameter of the first tubular member 110.

The second tubular member 105 can be releasably secured to the first tubular member 110, by one or more mechanical fasteners or shear screws 117. The shear screws 117 can act as a setting mechanism. As such the shear screw 117 can allow the application of axial force from the surface through the second tubular member 105 to the first tubular member 110 one or more times during a completion installation processes. For example, the axial force can be utilized to stab the first tubular member 110 into a sub packer or other piece of downhole equipment.

In one or more embodiments, a collet or other spring mechanism (not shown) can be used as a setting mechanism. For example, a collet can be configured to engage the first tubular member 110 and the second tubular member 105, which can allow application of axial force from the surface through the second tubular member 105 to the first tubular member 110. The collet or spring mechanism can be configured to be resettable, allowing the repeated application of axial force through the contraction joint 100.

The second tubular member 105 can have an inner portion that is recessed or otherwise configured to mate with or connect with an extension 119. The extension 119 can also be connected to a top sub 129 at an "upper" or first end or portion 118 thereof. The extension 119 can connect the top sub 129 to the first end 108 of the second tubular member 105. In one or more embodiments, the first end 108 of the second tubular member 105 can connect directly to the top sub 129. In one or more embodiments, more than one extension 119 can be disposed between the top sub 129 and the second tubular member 105. In at least one specific embodiment, the top sub 129 can connect to an electrical submersible pumping system (ESP) or any other completion assembly (not shown).

As used herein, the terms "up" and "down"; "upper" and "lower"; "upwardly" and "downwardly"; "upstream" and "downstream"; and other like terms are merely used for convenience to depict spatial orientations or spatial relationships relative to one another in a vertical wellbore. However, when applied to equipment and methods for use in wellbores that are deviated or horizontal, it is understood to those of ordinary skill in the art that such terms are intended to refer to a left to right, right to left, or other spatial relationship as appropriate.

Figure 2:
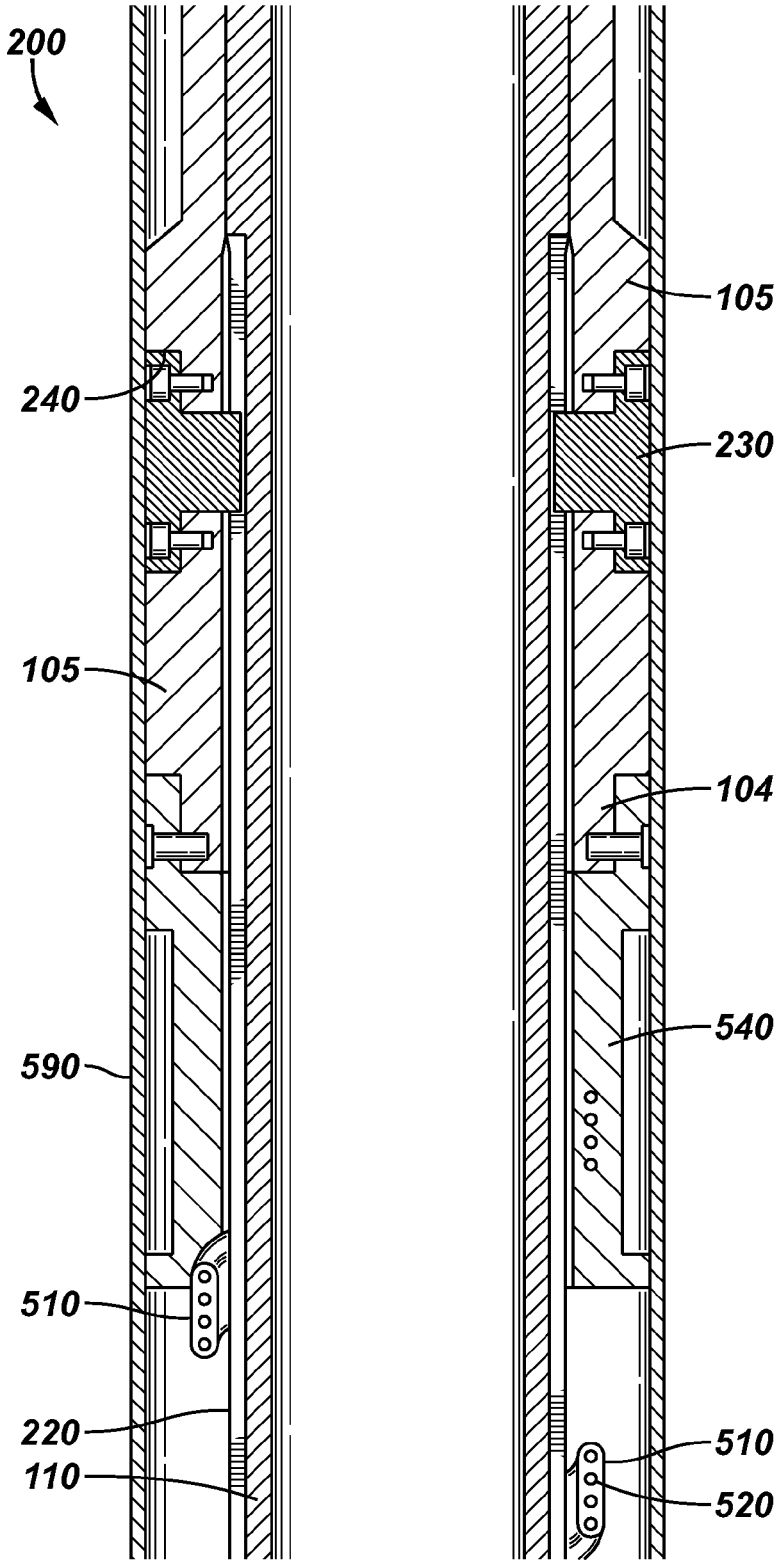
FIG. 2 depicts an enlarged cross section view of an illustrative anti-rotation assembly, according to one or more embodiments described.

Considering the anti-rotation assembly 200 in more detail, FIG. 2 depicts an enlarged cross section view of an illustrative anti-rotation assembly 200, according to one or more embodiments. The anti-rotation assembly 200 can include one or more axial slots 220, keys 230, and key holes 240. The one or more axial slots 220 can be formed within or through the outer diameter of the first tubular member 110. A first end of each key 230 can be at least partially disposed within each slot 220. A second end of each key 230 can be at least partially disposed within each key hole 240, which is formed in the second tubular member 105. As such, each key 230 can extend through the second tubular member 105 to the first tubular member 110. The key 230 and axial slot 220 can prevent rotation of the tubular members 105, 110 relative to one another, while allowing axial movement of the tubular members 105, 110 relative to one another. As will be explained in more detail below, the key 230 provides a rotation lock on the tubular members 105, 110 and allows axial or longitudinal movement of the tubular members 105, 110 by axially moving within the slots 220.

In one or more embodiments, the keys 230 can be pins, lock keys, bolts, or like devices. The second end of the key 230 can be locked into the key hole 240 by a retaining member (not shown). The retaining member can be a snap ring, a set screw, a cap, or like device. In one or more embodiments, the first end of the key 230 can be at least partially threaded and can threadably secure to a portion of the second tubular member 105.

The axial slot 220 can be a groove or channel formed longitudinally into the outer surface of the first member 110. In one or more embodiments, the axial slot can have a depth equal to a wall thickness of the first tubular member 110, which can allow the first end of the key 230 to extend into the inner diameter of the first tubular member 110. In the alternative, the axial slot can have a depth less than the wall thickness of the first tubular member 110 but deep enough to ensure that the key 230 will remain therein even when rotation force is experienced by the key 230.

Considering the control line assembly or section 500 in more detail, the control line assembly or section 500 can include one or more axially compliant housings 510. The axially compliant housing 510 can be made of a spiral, helical, or slack type geometry to compensate for the contraction and expansion of the contraction joint 100. In one or more embodiments, the axially compliant housing 510 can be an encapsulated coil made of thermoplastic resin or other axially compliant material. In one or more embodiments, the encapsulated coil can be made from a composite material or other flexible material. The axially compliant housing 510 can be configured to accommodate cyclical loading. For example, the axially complaint housing 510 can be made of a material and have a design such that the axially compliant housing 510 does not fatigue or have a degradation of physical properties, when the axially compliant housing 510 is repeatedly expanded and compressed.

The axially compliant housing 510 can contain or encapsulate one or more control lines 520. The control lines 520 can be one or more hydraulic lines, electronic lines, fiber optic lines, or other control lines. In one or more embodiments, the axially compliant housing 510 can include a line organizer to keep one or more control lines 520 from tangling. The line organizer can be a plastic wrap that encapsulates the control lines 520. Alternatively, the line organizer can be a metal armor that holds the control lines 520 together.

A shroud 590 can be at least partially disposed about the control line assembly 500 to further protect the control lines 520 from debris or entanglement within the wellbore. The shroud 590 can be a tubular, liner, or any other protective covering. In one or more embodiments, the shroud 590 can also be disposed about at least a portion of the second tubular member 105 and the first tubular member 110. In one or more embodiments, the shroud 590 can be slotted or otherwise perforated.

The control line assembly 500 can further include one or more tubing hangers or holders 540, 545 for managing the control lines 520. A first tubing hanger 540 can be adjacent the first tubular member 110. For example, the first tubing hanger 540 can be adjacent the first end 112 of the first tubular member 110. A second tubing hanger 545 can connect to the first tubular member 110 adjacent the second end 114 thereof. The first tubing hanger 540 and the second tubing hanger 545 can secure one or more control lines 520 and/or a portion of the axially compliant housing 510 to the first tubular member 110 and/or the second tubular member 105. The first tubing hanger 540 and the second tubing hanger 545 can also serve as a transition piece for the control lines 520, i.e. to allow for transition from a smaller outside diameter of the control lines 520 to a larger outside diameter of the axially compliant housing 510 or vise versa.

The second tubing hanger 545 can be adjacent the first tubular member 110. For example, the second end 114 of the first tubular member 110 can be adjacent the second tubing hanger 545. A "lower" or second end of the second tubing hanger 545 can be recessed or otherwise configured to mate with or connect with an outer portion of the bottom sub 199.

The second tubing hanger 545 can sit adjacent or flush at an "upper" or first portion thereof with the first tubular member 110. The first tubing hanger 540 can be secured to the lower portion 104 of the second tubular member 105. Accordingly, the first tubing hanger 540 can axially move about the first tubular member 110, as the second tubular member 105 axially moves about the first tubular member 110.

Figure 3:
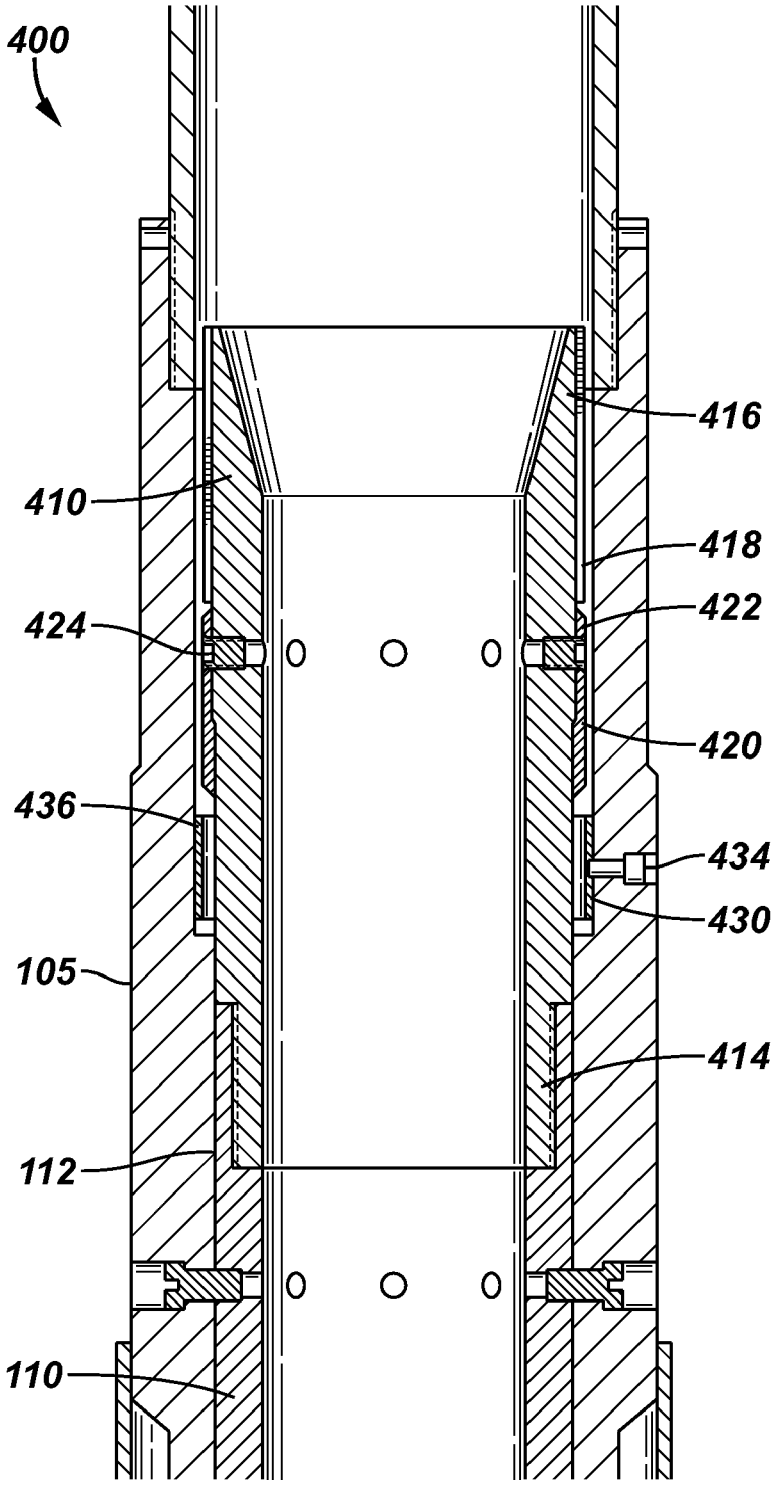
FIG. 3 depicts an enlarged cross section view of an illustrative re-setting assembly, according to one or more embodiments described.
Figure 4:
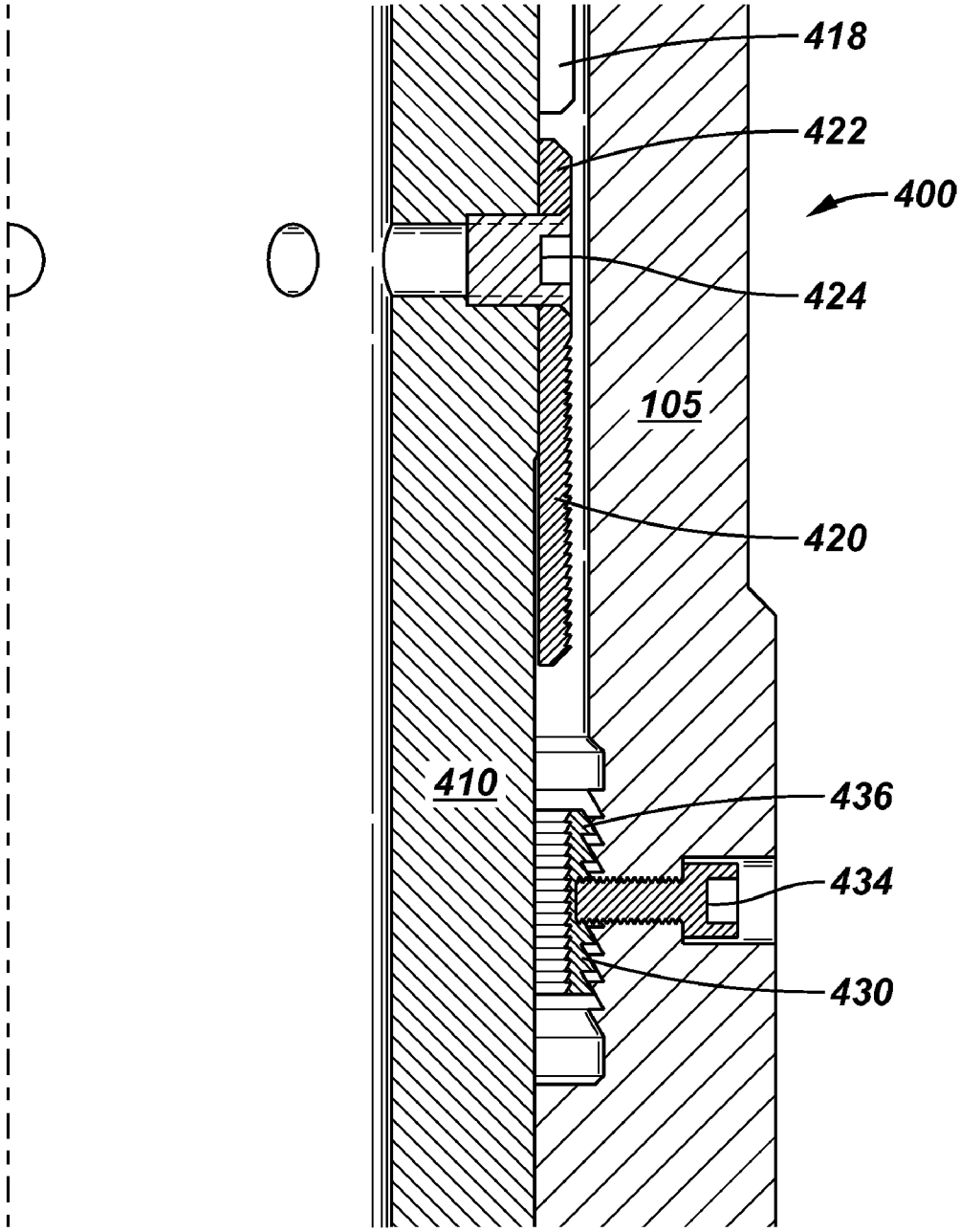
FIG. 4 also depicts an enlarged cross section view of an illustrative re-setting assembly, according to one or more embodiments described.

Considering the re-setting assembly 400 in more detail, FIGS. 3 and 4 depict enlarged cross section views of an illustrative re-setting assembly 400, according to one or more embodiments. The re-setting assembly 400 can include one or more lock rings or ratchet mechanisms 420 and one or more c-rings or split rings 430 disposed about an inner or shear mandrel 410. The shear mandrel 410 can connect to or otherwise engage the first tubular member 110. For example, the first tubular member 110 can have an inner diameter or portion recessed at the "upper" or first end 112 thereof and the shear mandrel 410 can have a recessed outer diameter or portion recessed at a "lower" or second end 414. Accordingly, the first tubular member 110 can be at least partially disposed about a second end 414 of the shear mandrel 410 without increasing the overall diameter of the mating area.

The lock ring 420 can be disposed on or about an outer portion of the shear mandrel 410 between an "upper" or first end 416 and the second end 414. The shear mandrel 410 can releasably secure the lock ring 420 to the first tubular member 110. The shear mandrel 410 can have a shoulder or stop 418 formed or disposed at a first end 416 thereof. The shoulder 418 can be adjacent the lock ring 420. For example, the shoulder 418 can be adjacent an "upper" or first end 422 of the lock ring 420. The shoulder 418 can be used to prevent a ring, such as a c-ring, from passing the first end 422 of the lock ring 420. The lock ring 420 can be releasably secured to the shear mandrel 410 or the first tubular member 110 by a mechanical fastener 424, such as a shear screw, a clip, or other fastener that is configured to fracture or break under a pre-determined load. The load can be determined based on the strength of the mechanical fastener 424. In one or more embodiments, the lock ring 420 can be connected to or disposed about the outer surface of the first tubular member 110, and the shoulder 418 can be formed or disposed on the first tubular member 110 (not shown).

The lock ring 420 can be adjacent the c-ring 430. The c-ring 430 can secure to the second tubular member 105. For example, the c-ring 430 can secure to or adjacent the inner surface of the second tubular member 105. Any mechanical fastener 434, such as a setting screw or other fastener, can be used to secure the c-ring 430 to the second tubular member 105.

The c-ring 430 can be aligned with the lock ring 420; for example, the c-ring 430 can have a first end 436 adjacent the lock ring 420. Accordingly, the c-ring 430 can travel about the lock ring 420, when the second tubular member 105 is axially moved in a first direction. The c-ring 430 can be adapted to slide about or along the lock ring 420 when traveling in the first direction, and the c-ring 430 can secure to the lock ring 420 when axially moving in a second direction. For example, the lock ring 420 and c-ring 430 can both have teeth; the teeth of the c-ring 430 can slide smoothly about the teeth of the lock ring 420 in the first direction. However, when the c-ring 430 is traveling in the second direction, the teeth of the rings 420, 430 can engage.

Figure 5:
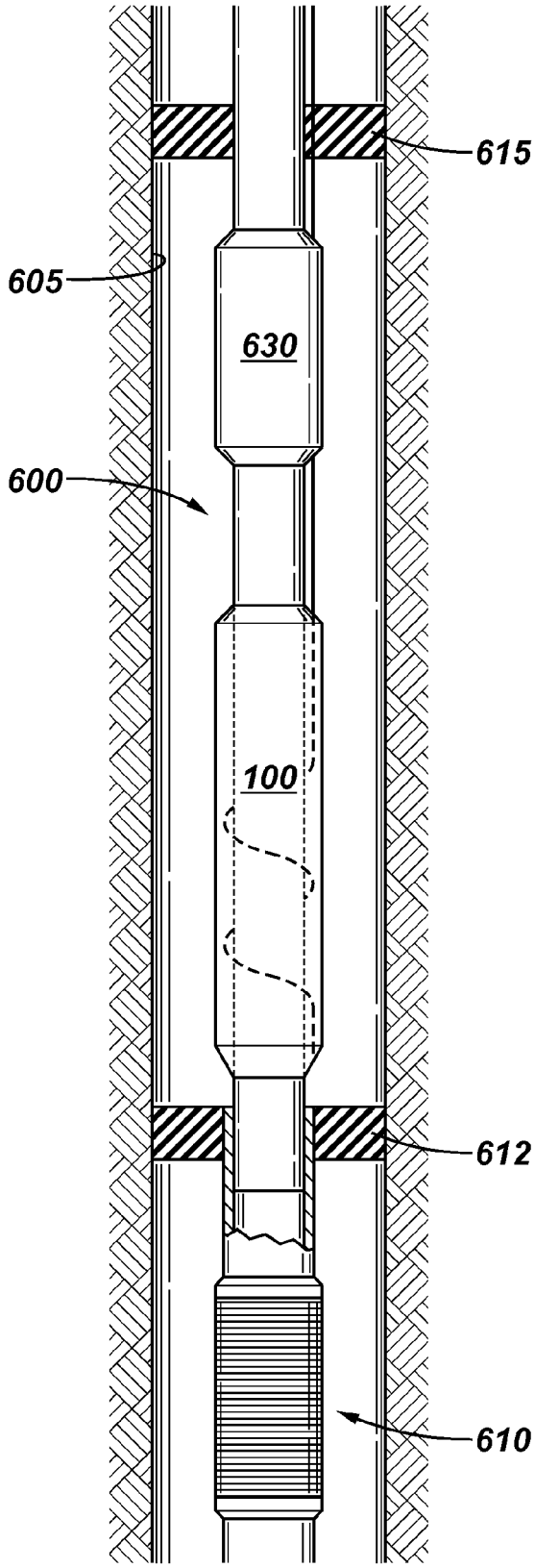
FIG. 5 depicts a schematic view of an illustrative completion system utilizing a contraction joint, according to one or more embodiments described.

FIG. 5 depicts a schematic view of an illustrative completion system 600 utilizing one or more contraction joints 100, according to one or more embodiments. The completion system 600 can include a "lower" or first completion assembly 610, an "upper" or second completion assembly 630, and one or more contraction joints 100 can be disposed therebetween. One or more packers 615, 612 can be disposed about the completion system 600 to isolate the second completion assemblies 610, 630 from one another.

Each completion assembly 610, 630 can be a pump, sand control system, hydraulic connector, wet mate, flow control valve, packer, bridge plug, or any other downhole completion device or system. For simplicity and ease of description, the completion system 600 will be further described with reference to a particular embodiment wherein the first or "lower" completion assembly 610 is a sand control assembly and the second or "upper" completion assembly 630 is an ESP.

The completion assembly 610 can include one or more particulate control devices (not shown), one or more flow ports, or other like equipment that can be used to perform a gravel pack or other sand completion operation. The particulate control devices can include one or more sand control screens. For example, the particulate control devices can be a wire wrapped screen or mechanical type screen, or combinations thereof. An illustrative sand control screen is described in more detail in U.S. Pat. No. 6,725,929.

The packers 615, 612 can include one or more sealing members. Illustrative sealing members can include packers, seals, or other downhole sealing devises capable of sealing off an annular region or annulus between the completion system 600 and a wellbore, such as wellbore 605. Illustrative packers can include compression or cup packers, inflatable packers, "control line bypass" packers, polished bore retrievable packers, other common downhole packers, or combinations thereof. In one or more embodiments, the packers 615, 612 can be made of a swellable material or can be a packer that can be expanded to engage the walls of the wellbore 605.

In operation, the first completion assembly 610 and the packer 612 can be conveyed or otherwise disposed within the wellbore 605. The packer 612 can be set and can hold the first completion assembly 610 in place. For example, the packer 612 can be set by applying pressure to the wellbore, by applying pressure through the first completion assembly 610, by the use of a control line, or in other ways known in the art.

The second completion assembly 630 can be connected to the contraction joint 100. The control lines 520 within the axially compliant housing 510 can be connected to control lines of the second completion assembly 630. The second completion assembly 630 and the contraction joint 100 can be conveyed into the wellbore 605, and the contraction joint 100 can stab into or connect with the packer 612. The completion system 600 can be marked at the surface to properly fit the length of the wellbore 605. Once marked, the second completion assembly 630 and the contraction joint 100 can be removed from the wellbore 605. Upon removal of the second completion assembly 630 and the contraction joint 100, the length of second completion assembly 630 can be adjusted, such that the completion system 600 can sit flush with or near flush with the top of the wellbore 605.

Once the length of the completion system 600 is adjusted, the second completion assembly 630 can be conveyed back into the wellbore 605, and the contraction joint 100 can stab into or connect with the packer 612. Once the second completion assembly 630 is connected with the packer 612, the contraction joint 100 can be set.

To set the contraction joint 100, axial force can be applied to the second tubular member 105 through the second completion assembly 630. The axial force can break the shear screw 117. When the shear screw 117 is broken, the second tubular member 105 can be released from the first tubular member 110. When the first tubular member 110 is released from the second tubular member 105, the second tubular member 105 can be axially moved to a second position along the first tubular member 110.

The second position can be any axial position relative to the first tubular member 110, which allows the second tubular member 105 a degree of travel sufficient to compensate for expansion or contraction of at least one of the completion assemblies 610, 630. For example, the second position can be such that the second tubular member 105 can move from about 2 feet, 3 feet, 4 feet, or more about the first member 110.

If the second completion assembly 630 is in the correct or desired location after positioning the second tubular member 105 at the second position, the completion system 600 can be set in place by setting the packer 615. However, if the completion system 600 is still not fitting properly within the wellbore 605, readjustment of the length of the completion system 600 may be desired.

To readjust the completion system 600, removal of the second completion assembly 630 and the contraction joint 100 from the wellbore 605 may be desirable. To accomplish removal of the second completion assembly 630 and the contraction joint 100, the contraction joint 100 can be reset using the re-setting assembly 400. To reset the contraction joint 100, the c-ring 430 can be moved along the lock ring 420 until the c-ring 430 contacts the shoulder 418. When the c-ring 430 is engaged with the shoulder 418, the shoulder 418 and the lock ring 420 can prevent the c-ring 430 from moving axially. Consequently, the first tubular member 110 is locked to the second tubular member 105. With the first tubular member 110 and the second tubular member 105 locked together, force can be applied to the second completion assembly 630 to remove the contraction joint 100 and the second completion assembly 630 from the wellbore 605. After removal of the second completion assembly 630 and the contraction joint 100 from the wellbore 605, the length of the second completion assembly 630 can be readjusted.

After readjustment of length of the second completion assembly 630, the second completion assembly 630 and the contraction joint 100 can be conveyed back into the wellbore 605. The contraction joint 100 can stab into or connect with the packer 612, and the contraction joint 100 can be set.

To set the contraction joint 100, axial force can be applied to the second tubular member 105 to break the mechanical fastener 424. After breaking the mechanical fastener 424, the second tubular member 105 is free to axially move about the first tubular member 110. The second tubular member 105 can be positioned about the first tubular member 110. Accordingly, the second tubular member 105 can move about the first tubular member 110 to accommodate for contraction or expansion of one or more of the completion assemblies 630, 610. Once the second tubular member 105 is properly positioned, the packer 615 can be set to hold the second completion assembly 630 in place. When the completion assemblies 630, 610 are secured in place, the completion system 600 is secured within the wellbore 605.

When the contraction joint 100 stabs into the packer 612, either in the first attempt or second attempt, the control lines 520 within the axially compliant housing 510 can connect to the control lines of the first completion assembly 610 with a wet mate connection. The control lines 520 in the axially compliant housing 510 can communicate the control lines of the first completion assembly 610 to the control lines of the second completion assembly 630. A hydraulic wet mate system as shown in U.S. Patent Application Publication No. 2008/0029274 can be used to connect the hydraulic control lines.

The first completion assembly 610 and/or second completion assembly 630 can expand or contract, due to temperature changes and/or gradients within the wellbore 605. When the completion assemblies 610, 630 expand or contract, the second tubular member 105 can axially move about the first tubular member 110. When the second tubular member 105 axially moves about the first tubular member 110, the axially compliant housing 510 can expand and contract along the first tubular member 110. Consequently, the axially compliant housing 510 can prevent tangling or knotting of the control lines 520 and preserve the integrity of the control lines 520.

In one or more embodiments, the first completion assembly 610 and the second completion assembly 630 can be joined together at the surface by the contraction joint 100, and the completion assemblies 610, 630 and the contraction joint 100 can be conveyed into the wellbore 605 together. In this, non-limiting, embodiment, the first completion assembly 610 can be secured within the wellbore 605 by one of the following: being stabbed into a packer already installed within the wellbore 605; setting the packer 612; being stabbed into an additional assembly already installed within the wellbore 605; and like ways. It is contemplated that if the length of the completion system 600 has to be adjusted to fit properly within the wellbore 605, the contraction joint 100 can be removed from the packer 612. After removal of the contraction joint 100 from the packer 612, the contraction joint 100 and the second completion 630 can be moved to the surface, for example, as described above.

However, in one or more embodiments, if the length of the completion system 600 has to be adjusted, the entire completion system 600 can be removed from the wellbore and the length of the completion system 600 can be adjusted at the surface. The actions for resetting the contraction joint 100; removing the completion system 600; and conveying the completion system 600 back into the wellbore 605 can be substantially similar to the actions discussed above.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A downhole contraction joint, comprising:

at least one anti-rotation assembly, comprising:

a first tubular member at least partially disposed within a second tubular member;

an axial slot formed through at least a portion of the first tubular member; and at least one key at least partially disposed within the second tubular member and the axial slot;

at least one resetting assembly disposed at a first end of the anti-rotation assembly, the resetting assembly, comprising:

a c-ring secured to the second tubular member; and a lock ring releasably secured to the first tubular member, wherein the lock ring is aligned with the c-ring; and at least one control line assembly disposed about a portion of the anti-rotation assembly, wherein the control line assembly comprises an axially compliant housing for containing one or more control lines.

2. The contraction joint of claim 1, wherein the axially compliant housing has a spiral, helical, or a slack type geometry and wraps around the outer diameter of the first tubular member.

3. The contraction joint of claim 2, wherein the axially compliant housing is an encapsulated coil.

4. The contraction joint of claim 1, wherein the control lines are hydraulic lines, electrical lines, or fiber optic lines.

5. The contraction joint of claim 1, wherein a first end of the second tubular member is connected to an electrical submersible pumping system.

6. The contraction joint of claim 1, wherein a second end of the first tubular member is connected to a bottom sub.

7. The contraction joint of claim 1, wherein the at least one key is an anti-rotation key, a pin, a screw, or a steel cylinder.

8. The contraction joint of claim 1, further comprising a plurality of control lines disposed within the axially compliant housing, and wherein the axially compliant housing holds the control lines together and prevents entanglement of the control lines.

9. A completion system comprising:

a downhole contraction joint, wherein the downhole contraction joint comprises:

at least one anti-rotation assembly, comprising:

a first tubular member at least partially disposed within a second tubular member;

an axial slot formed through at least a portion of the first tubular member; and at least one key at least partially disposed within the second tubular member and the axial slot;

at least one resetting assembly disposed at a first end of the anti-rotation assembly, the resetting assembly, comprising:

a c-ring secured to the second tubular member; and a lock ring releasably secured to the first tubular member, wherein the lock ring is aligned with the c-ring; and at least one control line assembly disposed about a portion of the anti-rotation assembly, and wherein the control line assembly comprises an axially compliant housing for containing one or more control lines;

a second completion assembly connected to the second tubular member; and a packer connected to the second completion assembly.

10. The completion system of claim 9, wherein the axially compliant housing has a spiral or helical shape and wraps around the outer diameter of the first tubular member.

11. The completion system of claim 9, wherein the axially compliant housing is an encapsulated coil.

12. The completion system of claim 9, wherein the control lines are hydraulic lines, electrical lines, or fiber optic lines.

13. The completion system of claim 9, wherein the second completion assembly is an electrical submersible pumping system.

14. The completion system of claim 9, wherein the first tubular member is engaged with a first completion assembly in a wellbore.

15. The completion system of claim 9, wherein the at least one key is an anti-rotation key, a pin, a screw, or a steel cylinder.

16. The completion system of claim 9, further comprising a plurality of control lines, and wherein the axially compliant housing holds the control lines together and prevents entanglement of the control lines.

17. A method for connecting two downhole completions comprising:

connecting a first completion assembly with a second completion assembly, wherein a contraction joint is disposed between the first completion assembly and the second completion assembly, and wherein the contraction joint comprises:

at least one anti-rotation assembly, comprising:

a first tubular member at least partially disposed within a second tubular member;

an axial slot formed through at least a portion of the first tubular member; and at least one key at least partially disposed within the second tubular member and the axial slot;

at least one resetting assembly disposed at a first end of the anti-rotation assembly, the resetting assembly, comprising:

a c-ring secured to the second tubular member; and a lock ring releasably secured to the first tubular member, wherein the lock ring is aligned with the c-ring; and at least one control line assembly disposed about a portion of the anti-rotation assembly, wherein the control line assembly comprises an axially compliant housing for containing one or more control lines;

preventing axial movement of the first tubular member relative to the wellbore with the first completion assembly;

axially moving the second tubular member about the first tubular member by applying axial force to the second completion assembly; and preventing axial movement of the second completion assembly relative to the wellbore, wherein the second tubular member can axially travel about the first tubular member to compensate for contraction and expansion of at least one of the completion assemblies.

18. The method of claim 17, further comprising resetting the contraction joint, wherein resetting the contraction joint comprises engaging the c-ring with the lock ring by axially moving the second completion assembly.

19. The method of claim 17, further comprising preventing the second tubular member from rotating relative to the first tubular member.

20. The method of claim 17, wherein the second tubular member can axially move from about two feet to about six feet about the first tubular member.

* * * * *